US012514325B2

(12) United States Patent
Case et al.

(10) Patent No.: US 12,514,325 B2
(45) Date of Patent: Jan. 6, 2026

(54) BLADDERS AND FOOTWEAR INCORPORATING BLADDERS IN THE FOOT SUPPORTS AND UPPERS

(71) Applicant: NIKE, Inc., Beaverton, OR (US)

(72) Inventors: Patrick R. Case, Portland, OR (US); Yoon Jeong Choi, Portland, OR (US); Dervin A. James, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 235 days.

(21) Appl. No.: 18/213,631

(22) Filed: Jun. 23, 2023

(65) Prior Publication Data

US 2023/0413940 A1 Dec. 28, 2023

Related U.S. Application Data

(60) Provisional application No. 63/355,829, filed on Jun. 27, 2022.

(51) Int. Cl.
*A43B 1/14* (2006.01)
*A43B 7/32* (2006.01)

(52) U.S. Cl.
CPC . *A43B 1/14* (2013.01); *A43B 7/32* (2013.01)

(58) Field of Classification Search
CPC ..... A43B 7/32; A43B 13/189; A43B 23/029; A43B 13/20; A43B 1/14
See application file for complete search history.

(56) References Cited

U.S. PATENT DOCUMENTS 2,981,010 A 4/1961 Aaskov
4,217,705 A 8/1980 Donzis
5,784,807 A 7/1998 Pagel
5,846,063 A 12/1998 Lakic
5,985,383 A 11/1999 Allen et al.
6,014,823 A 1/2000 Lakic
6,170,173 B1 1/2001 Caston
(Continued)

FOREIGN PATENT DOCUMENTS

CN 207400394 U 5/2018
CN 210248619 U 4/2020
(Continued)

OTHER PUBLICATIONS

Oct. 2, 2023 (WO) International Search Report and Written Opinion—App PCT/US2023/026203, 11 pages.
(Continued)

*Primary Examiner* — Michael C Miggins
(74) *Attorney, Agent, or Firm* — Banner & Witcoff, Ltd.

(57) ABSTRACT

Bladders for footwear uppers, footwear components including the bladders, articles of footwear including the bladders, and/or methods of making and using such bladders are described. Such bladder systems may include two thermoplastic elastomer sheets joined together at an outer perimeter bond. The outer perimeter bond may be shaped such that the interior chamber of the bladder forms: (i) a foot support chamber portion for supporting at least a portion of a plantar surface of a wearer's foot and (ii) one or more side chamber portions forming at least part of one or more securing straps and/or at least part of one or more footwear upper components. The one or more side chamber portions extend outward from the foot support chamber portion and are in fluid communication with the foot support chamber portion.

18 Claims, 4 Drawing Sheets

(56) References Cited

U.S. PATENT DOCUMENTS

| | | | |
|---|---|---|---|
| 7,478,488 | B1 | 1/2009 | Davis et al. |
| 9,351,536 | B2 | 5/2016 | Schindler et al. |
| 9,420,847 | B2 | 8/2016 | Elder et al. |
| 9,468,252 | B2 | 10/2016 | Dimatteo |
| D817,607 | S | 5/2018 | Morrison |
| 9,974,361 | B2 | 5/2018 | Zeng |
| 10,499,707 | B2 | 12/2019 | Hobson et al. |
| 2004/0003515 | A1 | 1/2004 | Marvin et al. |
| 2005/0241185 | A1 | 11/2005 | Flood et al. |
| 2013/0227857 | A1 | 9/2013 | Schindler et al. |
| 2015/0059215 | A1 | 3/2015 | Burch |
| 2017/0013915 | A1 | 1/2017 | Caston, Jr. |
| 2018/0110286 | A1 | 4/2018 | Vuong |
| 2021/0112919 | A1 | 4/2021 | Marston |
| 2021/0361030 | A1 | 11/2021 | Hopkins |

FOREIGN PATENT DOCUMENTS

| | | | |
|---|---|---|---|
| KR | 0114451 | | 4/1998 |
| KR | 101098020 | B1 | 12/2011 |
| KR | 101116431 | B1 | 2/2012 |
| KR | 101627108 | B1 | 6/2016 |
| KR | 20170003566 | U | 10/2017 |

OTHER PUBLICATIONS

Sep. 28, 2023 (WO) International Search Report and Written Opinion—App. PCT/US2023/026200, 11 pages.

Coady, Serena, "Amazon is selling freezer slippers and ohter unlikely body cooling items," metro.co.uk, Jul. 24, 2019, <<https://web.archive.org/web/20190922163415/https://www.amazon.co.uk/Pair-cold-foot-wrap-feet/dp/B00VKTO11Y Discloses slippers with gel that one can freeze or warm, 3 pages.

"Isla Air Slides," blastiful.com, Accessed: Dec. 6, 2021, <<https://web.archive.org/web/20211206231424/https://blastiful.com/products/isla-eva-sofa-slides-women-thick-sole-soft-indoor-slippers-anti-slip-sandals-men-summer-platform-shoes-bath?variant=40513202815127, discloses slippers with air cushions, 4 pages.

"Comfort Gel Slippers," supportplus.com, Accessed: Dec. 6, 2021, <<https://web.archive.org/web/20211206233611/https://www.supportplus.com/FJ2592.html>>, discloses gel cushion slippers, 1 page.

BLADDERS AND FOOTWEAR INCORPORATING BLADDERS IN THE FOOT SUPPORTS AND UPPERS

FIELD OF THE INVENTION

The present invention relates to bladders and footwear incorporating such bladders in the foot supports and uppers and/or methods of making and using such bladders, foot supports, uppers, and/or articles of footwear. In some aspects of this technology, the bladders will form at least a portion of one or more footwear securing components, such as at least portions of securing straps, and/or at least a portion of one or more footwear upper components.

BACKGROUND

Conventional articles of footwear include two primary elements, an upper and a sole structure. The upper may provide a covering for the foot that securely receives and positions the foot with respect to the sole structure. In addition, the upper may have a configuration that protects the foot and provides ventilation, thereby cooling the foot and removing perspiration. The sole structure may be secured to a lower surface of the upper and generally is positioned between the foot and any contact surface. In addition to attenuating ground reaction forces and absorbing energy, the sole structure may provide traction and control potentially harmful foot motion, such as over pronation.

SUMMARY

This Summary is provided to introduce some general concepts relating to this technology in a simplified form that are further described below in the Detailed Description. This Summary is not intended to identify key features or essential features of the invention.

Aspects of this technology relate to bladders, footwear components including such bladders, and articles of footwear (e.g., sandals, slides, flip-flops, or other types of footwear, including athletic footwear) including such bladders, e.g., of the types described and/or claimed below and/or of the types illustrated in the appended drawings. In some aspects of this technology, the bladders will include bladder chambers and fluid passages configured to move fluid (e.g., when the footwear is secured to a wearer's foot) from beneath the wearer's foot to the securing strap(s) and/or other footwear upper components, which may form at least a portion of an overall upper for the article of footwear. Such bladders, uppers, and/or articles of footwear may include any one or more structures, parts, features, properties, and/or combination(s) of structures, parts, features, and/or properties of the examples described and/or claimed below and/or of the examples illustrated in the appended drawings.

More specific aspects of this technology relate to bladder systems for articles of footwear that include a first thermoplastic elastomer sheet and a second thermoplastic elastomer sheet joined to the first thermoplastic elastomer sheet by an outer perimeter bond. The first and second thermoplastic elastomer sheets may be formed from one thermoplastic elastomer sheet component (e.g., folded over along one or more edges) or two (or more) separate sheet components. An interior chamber (e.g., a fluid-tight chamber for containing a fluid, such as a gas) is defined between the first thermoplastic elastomer sheet and the second thermoplastic elastomer sheet and inside of the outer perimeter bond. The outer perimeter bond may be shaped such that the interior chamber forms: (i) a foot support chamber portion for supporting at least a portion of a plantar surface of a wearer's foot, (ii) a first side chamber portion forming at least part of a first securing strap (and/or at least part of a first footwear upper component), wherein the first side chamber portion extends outward from a first side of the foot support chamber portion and is in fluid communication with the foot support chamber portion, and, optionally, (iii) a second side chamber portion forming at least part of a second securing strap (and/or at least part of a second footwear upper component), wherein the second side chamber portion extends outward from a second side of the foot support chamber portion and is in fluid communication with the foot support chamber portion. The second side of the foot support chamber portion may be located on an opposite side of the foot support chamber portion from the first side of the foot support chamber portion.

While aspects of this technology are described in terms of bladders, footwear components including such bladders, and articles of footwear (e.g., sandals, slides, flip-flops, or other types of footwear, including athletic footwear) including such bladders, additional aspects of this technology relate to methods of making such bladders, footwear components, and/or articles of footwear and/or methods of using such bladders, footwear components, and/or articles of footwear.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

DETAILED DESCRIPTION

Figure 1A:
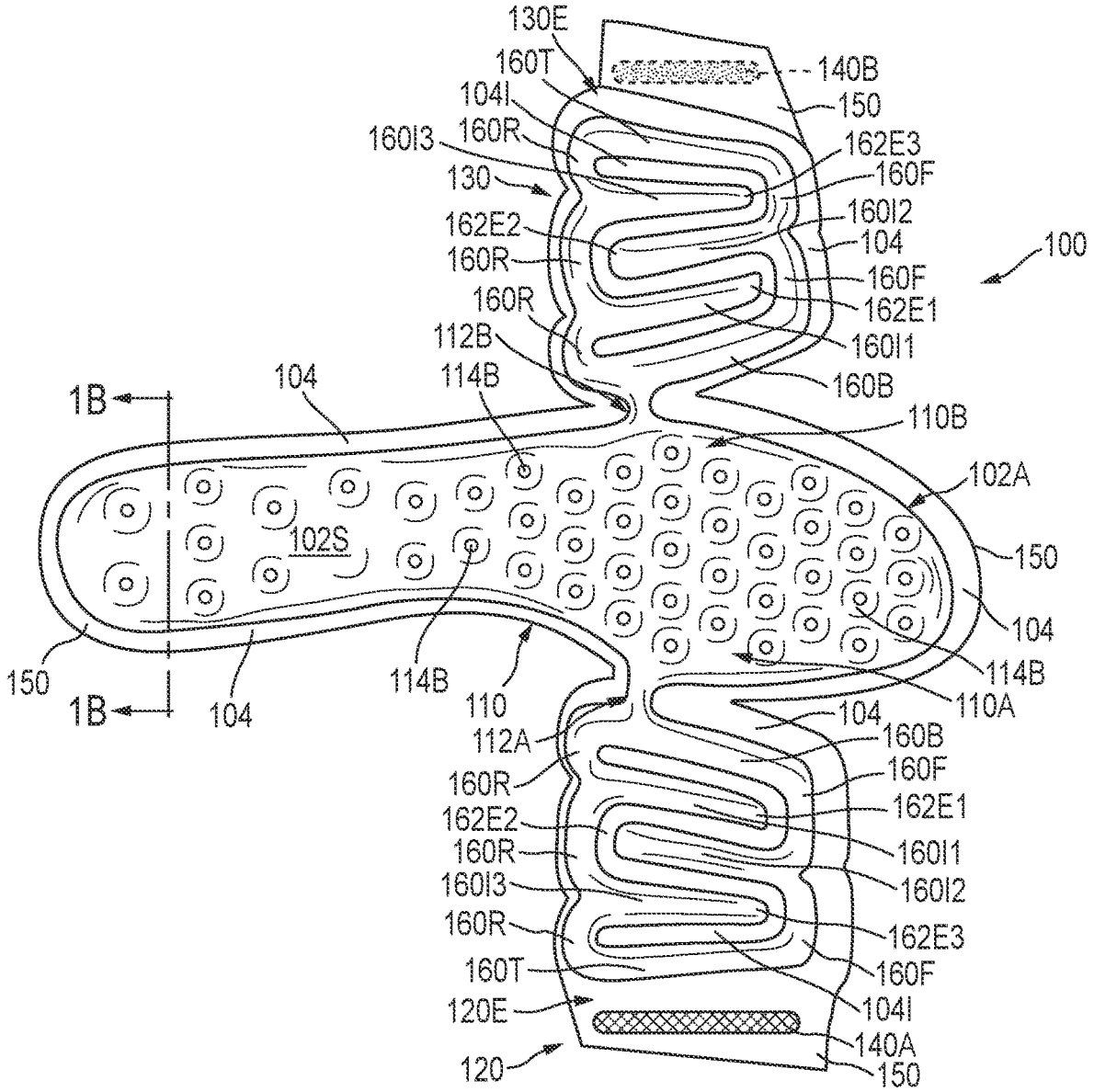
FIG. 1A illustrates a bladder system in accordance with at least some examples of this technology.

In the following description of various examples of bladders, footwear components, and/or articles of footwear according to the present technology, reference is made to the accompanying drawings, which form a part hereof, and in which are shown by way of illustration various example structures and environments in which aspects of the technology may be practiced. It is to be understood that other structures and environments may be utilized and that structural and functional modifications may be made to the specifically described structures, functions, and methods without departing from the scope of the present disclosure.

This application describes footwear components (e.g., bladder systems, fabric layers, sole components, etc.) that are "bonded" together. The term "bonded" (and derivatives thereof) means that the components are joined securely to one another. The term "bonded" encompasses bonds formed using adhesives or cements (including hot melt adhesives) as well as bonds formed in an "adhesive free" manner, i.e., without use of a separate adhesive component. "Adhesive free" bonds include bonds formed by fusing or melting components together (e.g., if the components include compositions that are compatible to mix and join together to form a bond, such as two components including a thermoplastic polyurethane component); bonds formed by welding techniques (e.g., RF welding, ultrasonic welding, high-frequency welding, laser welding, impulse welding, etc.); bonds formed by heat sealing; etc. Some adhesive free bonds may form a seamless joint between the two previously separate components (e.g., the materials mix and join together and then re-harden with no discernible junction). The term "melt bond" and variations thereof, as used herein, mean bonds formed where localized melting of each component occurs (e.g., melting of the thermoplastic polymer present in each component), the melted components combine together, and then the combined components harden to thereby "fuse" and "bond" the two components together. Such melt bonded joints are adhesive free and may be seamless. The term "engaged with" is used herein as a generic term and includes both adhesive based bonds and adhesive free bonds within its scope as well as other potential types of engagement that fix two (or more) components together (including through the use of mechanical connectors or fasteners, through the use of sewing or stitching, etc.).

This application and/or its claims use the adjectives, e.g., "first," "second," "third," and the like, to identify certain components and/or features relating to this technology. These adjectives are used merely for convenience, e.g., to assist in maintaining a distinction between components and/or features of a specific structure or structures. Use of these adjectives should not be construed as requiring a specific order or arrangement of the components and/or features being discussed. Also, use of these specific adjectives in the specification for a specific structure does not require that the same adjective be used in the claims to refer to the same part (e.g., a component or feature referred to as the "fourth" in the specification may correspond to any numerical adjective used for that component or feature in the claims).

Also, as used herein, the term "forefoot" (as in "forefoot portion," "forefoot region," or the like) relates to portions, regions, structures, or components located in and/or associated with a forward ⅓ of an article of footwear, sole structure, or component thereof; the term "midfoot" (as in "midfoot portion," "midfoot region," or the like) relates to portions, regions, structures, or components located in and/or associated with a middle ⅓ of an article of footwear, sole structure, or component thereof; and the terms "heel" or "rearfoot" (as in "heel portion," "heel region," "rearfoot portion," "rearfoot region," or the like) relate to portions, regions, structures, or components located in and/or associated with a rearward ⅓ of an article of footwear, sole structure, or component thereof.

I. General Description of Aspects of this Technology

As noted above, aspects of this technology relate to bladders, footwear components including such bladders, and articles of footwear (e.g., sandals, slides, flip-flops, or other types of footwear, including athletic footwear) including such bladders, e.g., of the types described and/or claimed below and/or of the types illustrated in the appended drawings. Such bladders, footwear components including such bladders, and articles of footwear including such bladders may include any one or more structures, parts, features, properties, and/or combination(s) of structures, parts, features, and/or properties of the examples described and/or claimed below and/or of the examples illustrated in the appended drawings.

Bladder systems for articles of footwear in accordance with at least some aspects of this technology will include a first thermoplastic elastomer sheet and a second thermoplastic elastomer sheet joined to the first thermoplastic elastomer sheet by an outer perimeter bond. The first and second thermoplastic elastomer sheets may be formed from a single thermoplastic elastomer sheet component (e.g., folded over along one or more edges) or two (or more) separate sheet components. An interior chamber (e.g., a fluid-tight chamber for containing a fluid, such as a gas, optionally a gas under pressure) is defined between the first thermoplastic elastomer sheet and the second thermoplastic elastomer sheet and inside of the outer perimeter bond. In some examples of this technology, the outer perimeter bond is shaped such that the interior chamber forms: (i) a foot support chamber portion for supporting at least a portion of a plantar surface of a wearer's foot, (ii) a first side chamber portion forming at least part of a first securing strap (and/or at least part of a first footwear upper component), wherein the first side chamber portion extends outward from a first side of the foot support chamber portion and is in fluid communication with the foot support chamber portion, and, optionally, (iii) a second side chamber portion forming at least part of a second securing strap (and/or at least part of a second footwear upper component), wherein the second side chamber portion extends outward from a second side of the foot support chamber portion and is in fluid communication with the foot support chamber portion. The second side of the foot support chamber portion may be located on an opposite side of the foot support chamber portion from the first side of the foot support chamber portion.

In some examples of this technology, the foot support chamber portion will extend to form a heel support portion, a midfoot support portion, and a forefoot support portion, e.g., portions for supporting all or substantially all of an entire plantar surface of a wearer's foot. Alternatively, in other examples of this technology, the foot support chamber portion will extend to form any one or more of a heel support portion, a midfoot support portion, and/or a forefoot support portion. Further, in some examples, any one or more of the heel support portion, the midfoot support portion, and/or the forefoot support portion of a foot support chamber portion may include one or more interior bonds (e.g., any one or more portion may include a plurality of interior bonds) between interior surfaces of the first thermoplastic elastomer sheet and the second thermoplastic elastomer sheet. Such interior bonds, when present, may help to control the shape of the foot support chamber portion when it is inflated with gas.

Additionally or alternatively, in some examples of this technology, a first side fluid passageway may connect the foot support chamber portion with the first side chamber portion, and/or a second side fluid passageway may connect the foot support chamber portion with the second side chamber portion. When present, the first side fluid passageway may be located at a forefoot region and/or a midfoot region of the first side of the foot support chamber portion, and/or the second side fluid passageway may be located at a forefoot region and/or a midfoot region of the second side of the foot support chamber portion.

The first side chamber portion and/or the second side chamber portion also may include various structures to control shape and/or to make the side chamber portion(s) suitable for use as a securing strap of an article of footwear and/or for use as a footwear upper component. As some more specific examples, either or both of the first side chamber portion and/or the second side chamber portion may include a plurality of elongated chamber segments, e.g., in a staggered arrangement (and/or an alternating arrangement) along the chamber portion. One or more of these elongated chamber segments may be arranged to have its/their longitudinal direction (e.g., its longest and/or axial direction dimension) extending in a front-to-back direction of the bladder system and/or in a front-to-back direction of the sole structure and/or article of footwear in which the bladder system is contained. As some more specific examples, either or both of the first side chamber portion and/or the second side chamber portion may be structured to include: (i) a bottom base chamber portion, (ii) a top base chamber portion, (iii) a forward chamber portion extending between the bottom base chamber portion and the top base chamber portion, and (iv) a rearward chamber portion extending between the bottom base chamber portion and the top base chamber portion. Additionally, either or both of the first side chamber portion and/or the second side chamber portion may be structured to include: (i) a first elongated chamber portion, e.g., extending from the rearward chamber portion toward the forward chamber portion and terminating before reaching the forward chamber portion, (ii) a second elongated chamber portion, e.g., extending from the forward chamber portion toward the rearward chamber portion and terminating before reaching the rearward chamber portion, and/or (iii) a third elongated chamber portion, e.g., extending from the rearward chamber portion toward the forward chamber portion and terminating before reaching the forward chamber portion. More or fewer of these intermediate elongated chamber portions may be provided on either or both side chamber portions, e.g., in a staggered and/or alternating arrangement.

Bladder systems in accordance with at least some examples of this technology further may include a securing system for releasably holding the first side chamber portion in place with respect to the second side chamber portion (e.g., to secure or help secure the bladder system to a wearer's foot). In such structures, a foot receiving space may be defined between: (i) the foot support chamber portion and (ii) the first side chamber portion and the second side chamber portion when the first and second side chamber portions are secured together.

Additionally or alternatively, in at least some bladder system examples of this technology, a fabric layer or other support layer may be engaged with an exterior surface of the first thermoplastic elastomer sheet and/or the second thermoplastic elastomer sheet. The fabric layer or other support layer may form a surface configured to contact a wearer's foot. The fabric layer, when present, may make a more comfortable surface for contacting a wearer's foot, provide moisture wicking, prevent perspiration, etc. Additionally, in some examples of this aspect of the present technology, a securing system (e.g., of the types described above) may be provided having at least a portion engaged with the fabric layer or other support layer. The securing system may releasably hold the first securing strap in place with respect to the second securing strap, e.g., so as to form a foot receiving space between: (i) the foot support chamber portion and (ii) the first securing strap and the second securing strap when the first and second securing straps are secured together. Alternatively, at least one of the first side chamber portion and/or the second side chamber portion (if present) may be fixed in the footwear structure and/or may form at least a portion of an upper for the article of footwear.

Additional aspects of this technology relate to sole structures for articles of footwear that include a bladder system, e.g., of any of the types described above. Such sole structures may include: (a) a sole component; and (b) a bladder system of any of the types described above engaged with the sole component. The bladder system may be engaged with the sole component using one or more of: an adhesive bond, an adhesive free bond, one or more mechanical connectors, a fusing technique, etc. In some examples, at least the foot support chamber portion of the bladder system may be engaged with the sole component (e.g., with a plantar support surface of the sole component). The sole component may include a recess (e.g., in its top, plantar support surface) into which at least a portion of the bladder system (e.g., the bottom of the foot support chamber portion) is received. The sole component may comprise one or more component parts, such as one or more midsole components (e.g., a foam sole component, a midsole component including one or more mechanical shock absorbing components, etc.) and/or one or more outsole components.

Still additional examples of this technology relate to articles of footwear that include: (a) a sole component and (b) a bladder system of any of the types described above engaged with the sole component (e.g., in any of the manners described above). As described above, the bladder system may include a support layer (e.g., a fabric layer) and/or a securing system. The sole component may comprise one or more component parts, such as one or more midsole components (e.g., a foam sole component, a midsole component including one or more mechanical shock absorbing components, etc.) and/or one or more outsole components. In such articles of footwear, the first side chamber portion and/or the second side chamber portion may comprise at least portions of an upper for the article of footwear. Articles of footwear in accordance with some examples of this aspect of the present technology may form a sandal, slide, flip-flop, or other types of footwear, including athletic footwear.

Still additional examples of this technology relate to articles of footwear that consist only of or consist essentially of: (a) a sole component and (b) a bladder system of any of the types described above engaged with the sole component (e.g., in any of the manners described above). As described above, the bladder system may include a support layer (e.g., a fabric layer) and/or a securing system. The sole component may comprise one or more component parts, such as one or more midsole components (e.g., a foam sole component, a midsole component including one or more mechanical shock absorbing components, etc.) and/or one or more outsole components. In such articles of footwear, the first side chamber portion and/or the second side chamber portion may comprise at least portion(s) of an upper for the article of footwear. In some more specific examples, the first securing strap and the second securing strap may comprise an upper for the article of footwear. Articles of footwear in accordance with some examples of this aspect of the present technology may form a sandal, slide, flip-flop, or other types of footwear, including athletic footwear.

Further aspects of this technology relate to footwear components (e.g., foot sole structures) and/or articles of footwear including the bladder systems of the various types described above. Still additional aspects of this technology relate to methods of making the bladders, footwear components, and/or articles of footwear described above.

Given the general description of features, examples, aspects, structures, and methods according to examples of the technology provided above, a more detailed description of specific example footwear uppers, bladder systems, articles of footwear, and methods in accordance with this technology follows.

Figure 1B:
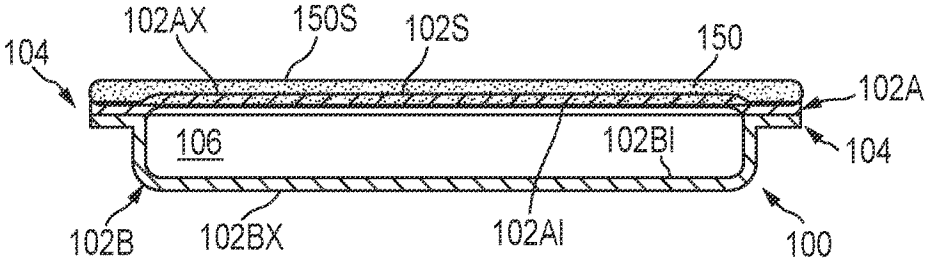
FIG. 1B provides a cross sectional view showing bladder system parts, e.g., taken along line 1B-1B in FIG. 1A.

II. Detailed Description of Example Bladder Systems, Footwear Components, and/or Articles of Footwear According to this Technology FIGS. 1A and 1B illustrate example bladder systems 100 for articles of footwear in accordance with some examples of this technology. In the view of FIG. 1A, the bladder system 100 is in a flat configuration, and FIG. 1B constitutes a cross sectional view along line 1B-1B in FIG. 1A. The bladder system 100 comprises a first thermoplastic elastomer sheet 102A (having an interior surface 102AI and an exterior surface 102AX) and a second thermoplastic elastomer sheet 102B (having an interior surface 102BI and an exterior surface 102BX) that are joined together (e.g., bonded or otherwise fixed together at interior surfaces 102AI, 102BI) by an outer perimeter bond 104. The two thermoplastic elastomer sheets 102A, 102B may be joined together in any desired manner, including in manners conventionally known and used in the footwear arts, e.g., via adhesives, via bonding techniques using heat and/or pressure, via melt bonding, via welding techniques (e.g., RF welding, ultrasonic welding, etc.), etc.

An interior chamber 106 is defined between the first thermoplastic elastomer sheet 102A and the second thermoplastic elastomer sheet 102B and inside of the outer perimeter bond 104. See FIG. 1B. Thus, the outer perimeter bond 104 and the thermoplastic elastomer sheets 102A, 102B in this example form a single, continuous, gas-tight (sealed), interior chamber 106. While the illustrated outer perimeter bond 104 extends around 100% of the outer perimeter of the bladder system 100, this is not a requirement. For example, if the first thermoplastic elastomer sheet 102A and the second thermoplastic elastomer sheet 102B constitute portions of a single sheet of thermoplastic elastomer material (e.g., that is folded on at least one edge), the outer perimeter bond 104 could form a sealed bond between overlapping portions of the first thermoplastic elastomer sheet 102A and the second thermoplastic elastomer sheet 102B at locations other than at the fold.

The outer perimeter bond 104 of this illustrated example is shaped such that the interior chamber 106 forms a foot support chamber portion 110 for supporting at least a portion of a plantar surface of a wearer's foot. As shown in FIG. 1A, the foot support chamber portion 110 of this example (and its interior chamber 106) extends to support all of or substantially all of the entire plantar surface of a wearer's foot (e.g., plantar support surface 102S extends continuously through (a) the heel support region, the midfoot support region, and the forefoot support region and (b) from a lateral side edge to a medial side edge). As some more specific examples, the foot support chamber portion 110 may be structured and arranged (e.g., within a sole structure or an article of footwear) such that a fluid-containing portion (e.g., interior chamber 106) of the foot support chamber portion 110 underlies and/or supports at least 75% of the plantar surface of a wearer's foot, and in some examples, from 75% to 100%, from 80% to 100%, from 85% to 100%, from 90% to 100%, or even from 95% to 100% of the plantar surface of a wearer's foot. Additionally or alternatively, the foot support chamber portion 110 may be structured and arranged (e.g., within a sole structure or an article of footwear) such that a fluid-containing portion (e.g., interior chamber 106) of the foot support chamber portion 110 forms at least 75% of the plantar support surface of a sole structure and/or an article of footwear, and in some examples, from 75% to 100%, from 80% to 100%, from 85% to 100%, from 90% to 100%, or even from 95% to 100% of the plantar support surface of a sole structure and/or an article of footwear.

FIG. 1A further shows that the foot support chamber portion 110 includes one or more spot welds or bonds 114B where the interior surface 102AI of the first thermoplastic elastomer sheet 102A is fixed to the interior surface 102BI of the second thermoplastic elastomer sheet 102B. These spot welds or bonds 114B assist in controlling the shape of the bladder system 100 (e.g., making the plantar support surface 102S contoured, e.g., to better conform to the shape of a wearer's foot). While any desired number and/or positioning of spot welds or bonds 114B or other structures (including other interior bonds) may be provided, in this illustrated example, more than 45 spot welds or bonds 114B are provided, e.g., distributed over the entire plantar support surface 102S of the foot support chamber portion 110. In some examples of this technology, the foot support chamber portion 110 may include ten or more interior structures (e.g., interior bonds of any size or shape, spot welds or bonds, interior tensile elements, etc.), and in some examples, from 10-75 such interior structures, from 20-70 such interior structures, or from 30-60 such interior structures. While any desired arrangement of the interior structures (e.g., interior bonds of any size or shape, spot welds or bonds, interior tensile elements, etc.) may be used, the illustrated example includes transverse rows of spot welds or bonds with the spot welds or bonds in adjacent rows offset or staggered somewhat from one another. The term "spot weld or bond," as used herein in this context, means a bonded engagement of two facing interior surfaces of the thermoplastic elastomer sheets (e.g., surfaces 102AI and 102BI) having no dimension greater than 10 mm (e.g., bonded at "spots" having a radius of 5 mm or less).

The outer perimeter bond 104 of this example bladder system 100 structure further is shaped to define a first side chamber portion 120 extending outward from a first side 110A of the foot support chamber portion 110. The first side chamber portion 120 in this example is located on a medial side of the foot support chamber portion 110. The first side chamber portion 120 is in fluid communication with the foot support chamber portion 110. In at least some examples, the portion of the interior chamber 106 within the first side chamber portion 120 may freely exchange fluid with the portion of the interior chamber 106 within the foot support chamber portion 110, e.g., via one or more fluid passageways, such as fluid passageway 112A. Further, in at least some examples of this technology, no valves, stop members, or other structures are present that would stop, alter, or control fluid flow between foot support chamber portion 110 and the first side chamber portion 120 (i.e., fluid can freely flow between these chamber portions 110, 120, e.g., via one or more fluid passageways such as fluid passageway 112A). In the illustrated example, the first side chamber portion 120 and the fluid passageway 112A connecting it to the foot support chamber portion 110 are located in a forefoot and/or midfoot region of the overall bladder system 100 (and/or within a forefoot region and/or midfoot region of a sole structure and/or article of footwear including such a bladder system 100). Additionally or alternatively, in at least some examples of this technology, the first side chamber portion 120 may be located so as to form at least a portion of a securing system (e.g., the first side chamber portion 120 may form at least a portion of a first securing strap and/or at least a portion of a footwear upper component) for an article of footwear that includes the bladder system 100. In use, the first side chamber portion 120 may at least partially extend across an instep portion of a wearer's foot to secure the wearer's foot with respect to the foot support chamber portion 110.

The outer perimeter bond 104 of this illustrated example further is shaped to define a second side chamber portion 130 extending outward from a second side 110B of the foot support chamber portion 110. The second side chamber portion 130 in this example is located on a lateral side of the foot support chamber portion 110. The second side 110B is on an opposite side of the foot support bladder portion 110 from the first side 110A (e.g., one side (e.g., 110A) being the medial side of the bladder system 100 and the other side (e.g., 110B) being the lateral side of the bladder system 100). The second side chamber portion 130 is in fluid communication with the foot support chamber portion 110. In at least some examples, the portion of the interior chamber 106 within the second side chamber portion 130 may freely exchange fluid with the portion of the interior chamber 106 within the foot support chamber portion 110, e.g., via one or more fluid passageways, such as fluid passageway 112B. Further, in at least some examples of this technology, no valves, stop members, or other structures are present that would stop, alter, or control fluid flow between foot support chamber portion 110 and the second side chamber portion 130 (i.e., fluid can freely flow between these chamber portions 110, 130, e.g., via one or more fluid passageways such as fluid passageway 112B). In the illustrated example, the second side chamber portion 130 and the fluid passageway 112B connecting it to the foot support chamber portion 110 are located in a forefoot and/or midfoot region of the overall bladder system 100 (and/or within a forefoot region and/or midfoot region of a sole structure and/or article of footwear including such a bladder system 100). Additionally or alternatively, in at least some examples of this technology, the second side chamber portion 130 may be located so as to form at least a portion of a securing system (e.g., the second side chamber portion 130 may form at least a portion of a second securing strap and/or at least a portion of a second footwear upper component) for an article of footwear that includes the bladder system 100. In use, the second side chamber portion 130 may at least partially extend across an instep portion of a wearer's foot to secure the wearer's foot with respect to the foot support chamber portion 110.

FIGS. 1A and 1B further show that this example bladder system 100 includes a support layer 150 (e.g., engaged with at least one of the thermoplastic elastomer sheets 102A, 102B). The support layer 150 may be formed from one or more pieces of any desired material, including fabric, plastic, cellulose based materials, etc. In the illustrated example, the support layer 150 extends to support the entire outer perimeter bond 104 of the bladder system 100 and/or to support an entire plantar surface of a wearer's foot (e.g., support layer 150 extends continuously through (a) the heel support region, the midfoot support region, and the forefoot support region and (b) from a lateral side edge to a medial side edge of the bladder system 100). The support layer 150 of this illustrated example further extends to areas for supporting the first side chamber portion 120 and the second side chamber portion 130 (and provide a support layer forming parts of the first and second securing straps and/or one or more footwear upper components mentioned above). The support layer 150 may provide a more comfortable surface for contacting a wearer's foot, e.g., a soft surface, a moisture wicking surface, a breathable surface, a surface less likely to induce perspiration, etc.

The support layer (e.g., a fabric layer 150), when present, may extend to cover any desired portion of the exterior surface (e.g., 102AX and/or 102BX) of one or both thermoplastic elastomer sheets 102A, 102B. As some more specific examples, the support layer (e.g., a fabric layer 150, formed from one or more parts) may be sized, shaped, and arranged to cover at least 75% of the exterior surface 102AX of the first thermoplastic elastomer sheet 102A in any one or more of the foot support chamber portion 110, the first side chamber portion 120, the second side chamber portion 130, and/or the overall first thermoplastic elastomer sheet 102A. In some examples, the support layer (e.g., fabric layer 150) may be sized, shaped, and arranged to cover from 75% to 100%, from 80% to 100%, from 85% to 100%, from 90% to 100%, or even from 95% to 100% of the exterior surface 102AX of the first thermoplastic elastomer sheet 102A in any one or more of the foot support chamber portion 110, the first side chamber portion 120, the second side chamber portion 130 and/or the overall first thermoplastic elastomer sheet 102A. Additionally or alternatively, the support layer (e.g., a fabric layer 150, formed from one or more parts) may be sized, shaped, and arranged to cover at least 75% of the exterior surface 102BX of the second thermoplastic elastomer sheet 102B in any one or more of the foot support chamber portion 110, the first side chamber portion 120, the second side chamber portion 130, and/or the overall second thermoplastic elastomer sheet 102B. In some examples, the support layer (e.g., fabric layer 150) may be sized, shaped, and arranged to cover from 75% to 100%, from 80% to 100%, from 85% to 100%, from 90% to 100%, or even from 95% to 100% of the exterior surface 102BX of the second thermoplastic elastomer sheet 102B in any one or more of the foot support chamber portion 110, the first side chamber portion 120, the second side chamber portion 130, and/or the overall second thermoplastic elastomer sheet 102B.

Further, as shown in FIG. 1A, the free ends 120E, 130E of the first side chamber portion 120 and the second side chamber portion 130 and/or the support layer 150 (e.g., a fabric layer) may include additional components of a securing system (e.g., components 140A, 140B shown in FIG. 1A). The securing system may hold the first securing strap (e.g., formed at least in part by first side chamber portion 120 and/or its support layer 150) in place with respect to the second securing strap (e.g., formed at least in part by second side chamber portion 130 and/or its support layer 150). The securing system may include any types of releasable securing structures, including one or more of: buckles; snaps; buttons; hook-and-loop fasteners; magnetic fasteners; intermeshing retainer structures; etc. Securing system component 140B is shown in broken lines in FIG. 1A because it may be located on the opposite side of the second side chamber portion 130 and/or the support layer 150 from the side visible in FIG. 1A. The securing system components (e.g., 140A, 140B) may be engaged with or otherwise provided with the first side chamber portion 120, the second side chamber portion 130, and/or the support layer 150 in any desired manner, including engaged or otherwise provided with the outer perimeter bond 104 of the bladder system 100 (e.g., by adhesives, by mechanical connectors, by bonding techniques, by sewing, by forming holes or openings through the outer perimeter bond 104, etc.).

FIG. 1A shows further example features of the first side chamber portion 120 and second side chamber portion 130 in accordance with some examples of this technology. As shown, in this illustrated example, the first side chamber portion 120 and the second side chamber portion 120 each includes a plurality of elongated chamber segments in a staggered arrangement. These elongated chamber segments are separated by one or more staggered internal bonds 104I between the interior surfaces 102AI, 102BI of the first and second thermoplastic elastomer sheets 102A, 102B (e.g., by a single internal bond 104I having an elongated, "back-and-forth" path that separates the elongated chamber segments from one another in a staggered arrangement). In the illustrated example, the elongated chamber segments are oriented such that their elongated, longitudinal direction (e.g., their longest dimension and/or axial direction dimension) extends in a front-to-back direction of the bladder system 100.

More specifically, as further shown in the example of FIG. 1A, each of the first side chamber portion 120 and the second side chamber portion 130 includes: (i) a bottom base chamber portion 160B (e.g., that connects with its respective fluid passageway 112A, 112B from the foot support chamber portion 110), (ii) a top base chamber portion 160T, (iii) a forward chamber portion 160F extending between the bottom base chamber portion 160B and the top base chamber portion 160T, and (iv) a rearward chamber portion 160R extending between the bottom base chamber portion 160B and the top base chamber portion 160T. Additionally, between the chamber portions 160B, 160T, 160F, 160R, each of the first side chamber portion 120 and the second side chamber portion 130 of this illustrated example further includes: (i) a first elongated chamber portion 160I1 extending from (in direct fluid communication with) the rearward chamber portion 160R toward the forward chamber portion 160F (and in this example, terminating before reaching the forward chamber portion 160F (note first elongated chamber portion free end 162E1)), (ii) a second elongated chamber portion 106I2 extending from (in direct fluid communication with) the first forward chamber portion 160F toward the first rearward chamber portion 160R (and in this example, terminating before reaching the first rearward chamber portion (note second elongated chamber portion free end 162E2)), and/or (iii) a third elongated chamber portion 160I3 extending from (in direct fluid communication with) the first rearward chamber portion 160R toward the first forward chamber portion 160F (and in this example, terminating before reaching the first forward chamber portion 160F (note third elongated chamber portion free end 162E3)). Portions (e.g., turning portions) of the internal bond(s) 104I may extend between and separate the free end(s) (e.g., 162E1, 162E3) from the forward chamber portion 160F and/or portions (e.g., turning portions) of the internal bond(s) 104I may extend between and separate the free end(s) (e.g., 162E2) from the rearward chamber portion 160R.

Figure 5:
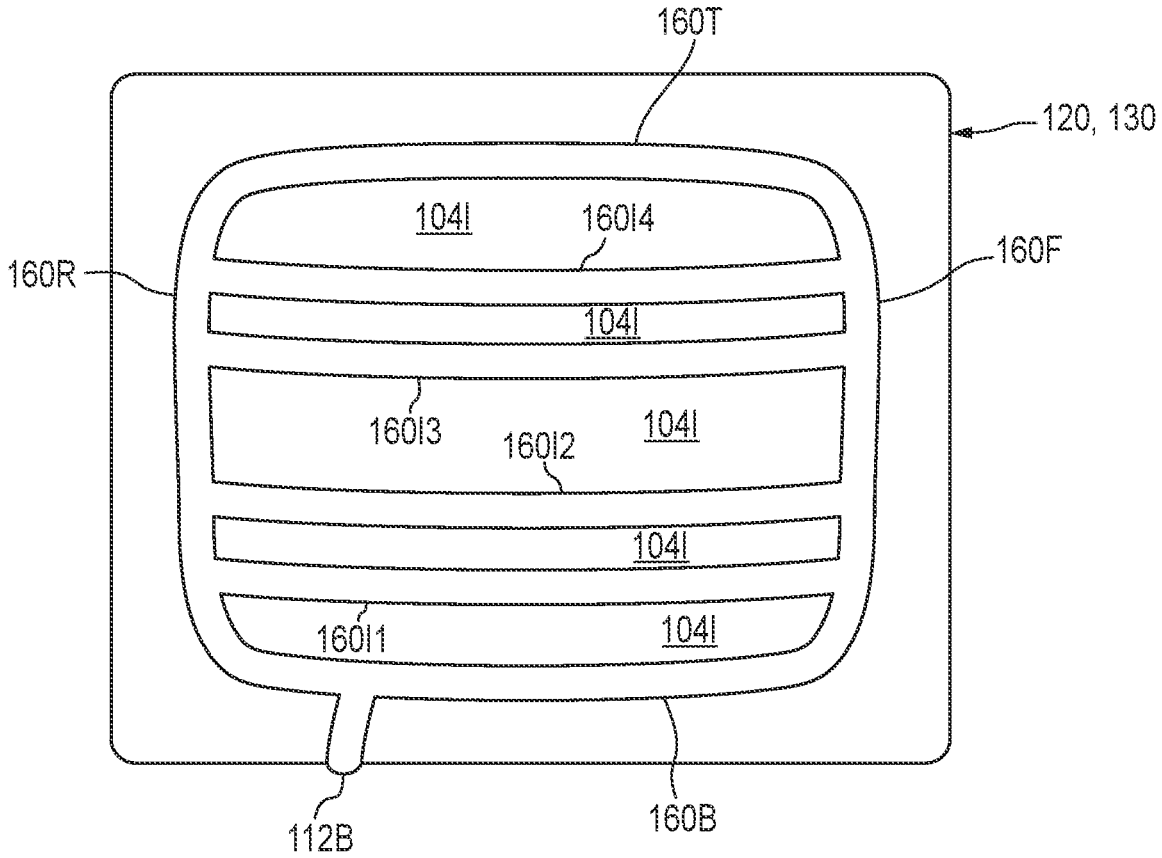
FIG. 5 illustrates an alternative arrangement of elongated fluid chamber segments on a first or second side fluid chamber portion, securing strap, and/or other footwear upper component.

Alternatively, if desired and as illustrated by FIG. 5, one or more intermediate elongated chamber portions (e.g., 160I1, 160I2, 160I3, and/or 160I4) could be in fluid communication with both the forward chamber portion 160F and the rearward chamber portion 160R (and/or with another chamber portion). In such structures, the internal bond 104I may constitute two or more independent and non-connected bond segments that separate the intermediate elongated chamber portions (e.g., 160I1, 160I2, 160I3, and/or 160I4) from one another. Other arrangements of fluid chambers within a side chamber portion 120, 130 and/or securing strap are possible without departing from aspects of this technology.

Figure 2:
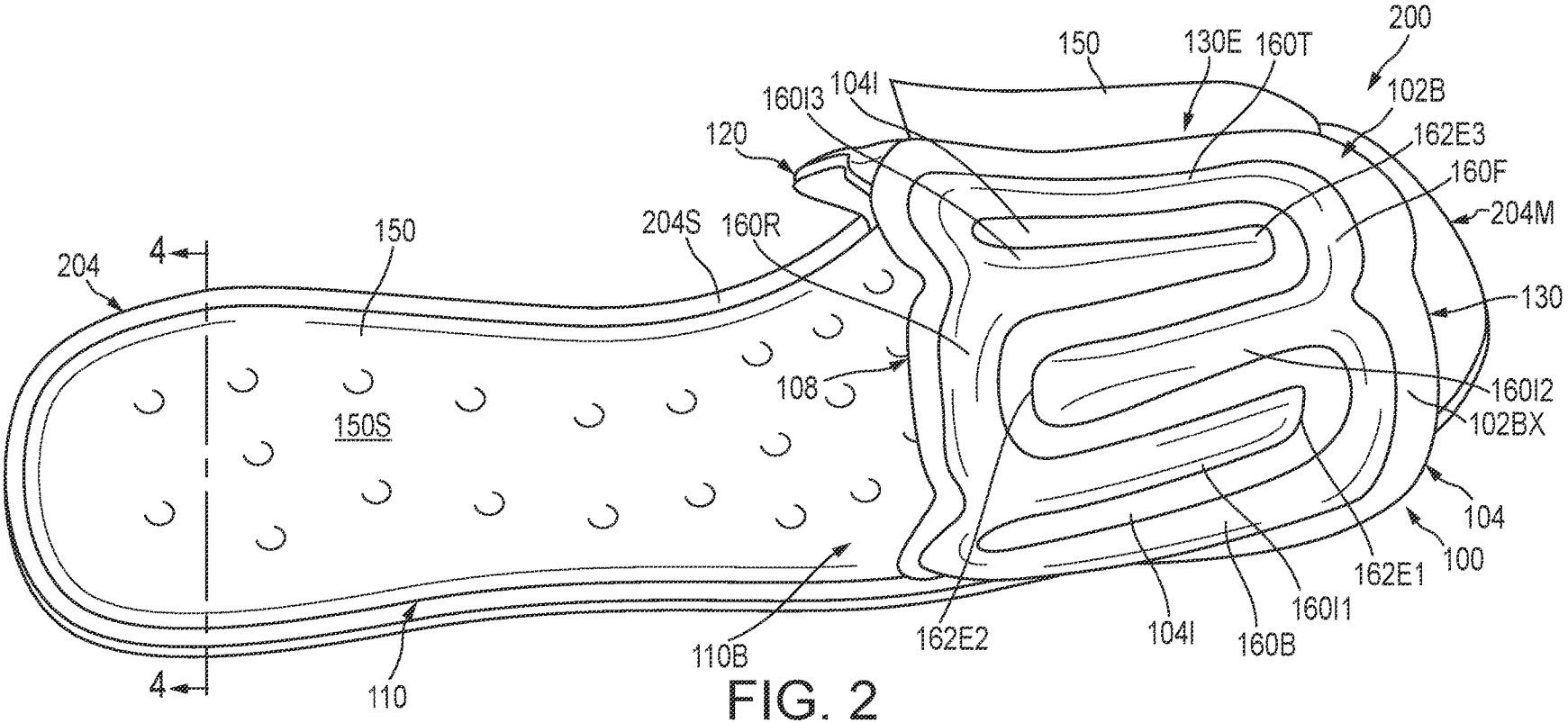
FIG. 2 illustrates a top view of an example article of footwear including a bladder system in accordance with some examples of this technology.
Figure 3:
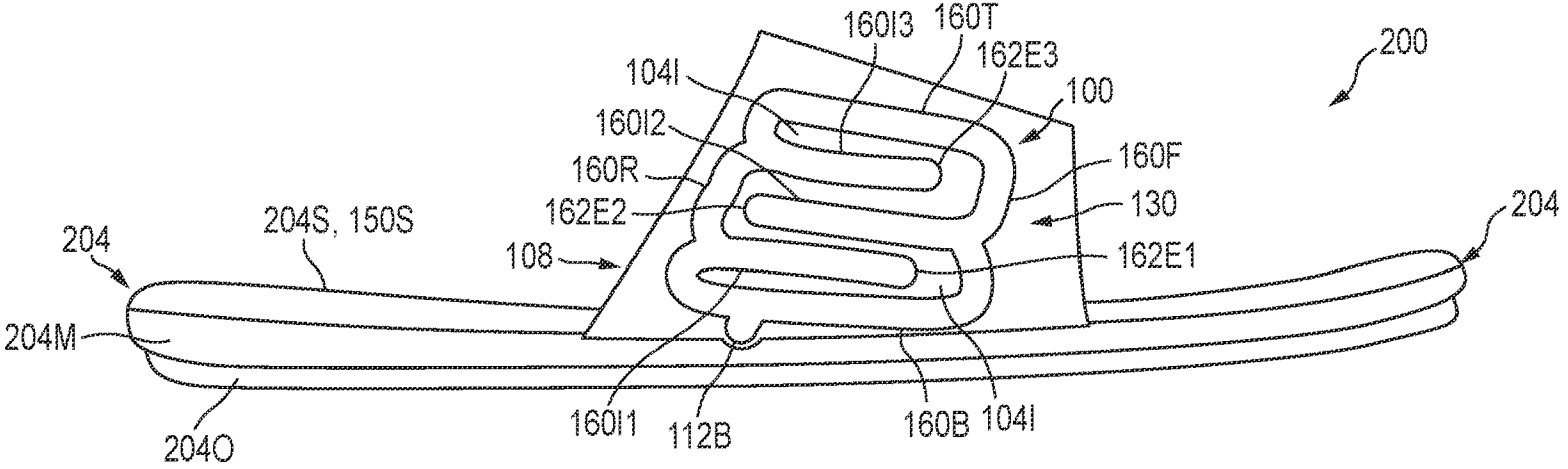
FIG. 3 illustrates a side view of an example article of footwear including a bladder system in accordance with some examples of this technology.
Figure 4:
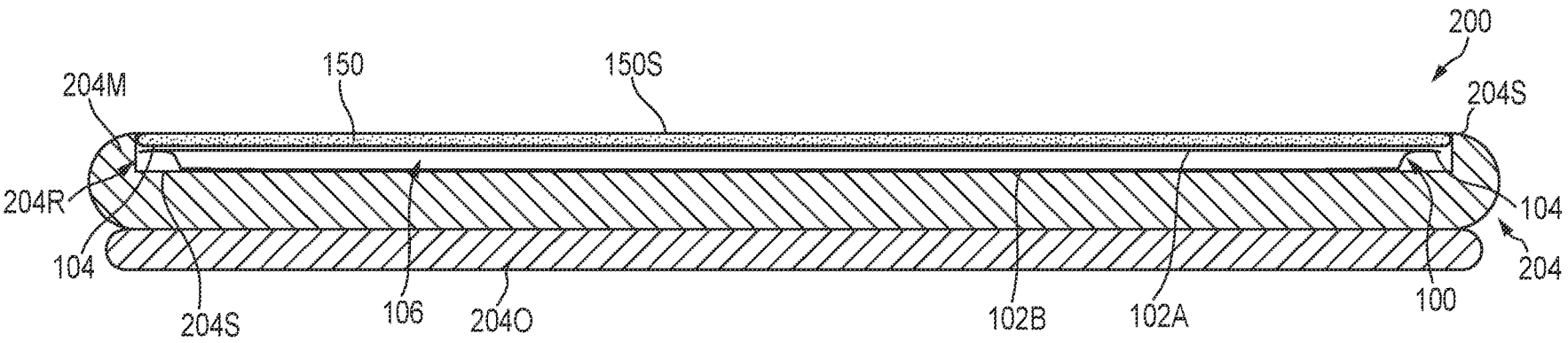
FIG. 4 provides a cross sectional view showing bladder system parts in a sole structure, e.g., taken along line 4-4 in FIG. 2.

FIGS. 2-4 provide various views illustrated the bladder system 100 (including support layer 150) incorporated into an article of footwear 200, e.g., a sandal, slide, flip-flop, or other footwear structure. FIGS. 2 and 3 show the article of footwear 200 with the first side chamber portion 120 and the second side chamber portion 130 (and the footwear upper components and/or straps containing them) secured together, thereby defining a foot receiving space 108 between the side chamber portions 120, 130 and the foot support chamber portion 110. FIG. 4 provides a cross-sectional view along line 4-4 of FIG. 2.

The bladder system 100 may form at least a portion of the sole component of the article of footwear 200 and at least a portion of the upper for the article of footwear 200. For example, as shown in FIGS. 2-4, at least the foot support chamber portion 110 of the bladder system 100 may be engaged with a sole component 204 (e.g., with a plantar support surface 204S) of an article of footwear 200. The bladder system 100 may be received in a recess 204R formed in the plantar support surface 204S of the sole component 204, e.g., such that the support layer 150 top surface 150S (if present) lies flush with and/or smoothly transitions into the top surface of the sole component 204 (e.g., midsole component 204M in the illustrated example of FIG. 4). In at least some examples of this technology, the bladder system 100 may be fixedly engaged with the sole component 204 (e.g., within the recess 204R), e.g., by one or more of: adhesives or adhesive-free bonding, one or more mechanical connectors, fusing techniques, and/or sewing, etc. In this illustrated example, the exterior surface 102AX of thermoplastic elastomer sheet 102A is fixed to the bottom surface of recess 204R by a bonding technique. See FIG. 4. The support layer 150 (e.g., fabric layer) may be engaged with the thermoplastic elastomer material (e.g., 102A) of a bladder component (e.g., with a bladder component 100 of the types described above) by adhesives, by adhesive free bonding, by welding techniques, etc., including in any of the ways described in U.S. Provisional Patent Appln. No. 63/277,916 filed Nov. 10, 2021 and/or described in U.S. Provisional Patent Appln. No. 63/277,932 filed Nov. 10, 2021. Each of U.S. Provisional Patent Appln. No. 63/277,916 and U.S. Provisional Patent Appln. No. 63/277,932 is entirely incorporated herein by reference. The foot support chamber portion 110 may be incorporated into the sole component 204 such that an exterior surface 150S of the support layer 150 (e.g., a fabric layer, when present) provides a direct contact surface for a wearer's foot (e.g., a plantar support surface).

The sole component 204 may include one or more parts. For example, the sole component 204 may include one or more foam components 204M, e.g., such as one or more midsole components made, at least in part, from a polyurethane foam material and/or an ethylvinylacetate (EVA) foam material. Additionally or alternatively, if desired, the sole component 204 may include one or more outsole components 204O, e.g., made, at least in part, from a synthetic rubber material, a foam material, etc. The outsole component(s) 204O may be structured and arranged to directly contact the ground when the article of footwear 200 is in use.

As further shown in FIGS. 2 and 3, in at least some examples of this technology, the first side chamber portion 120 and the second side chamber portion 130 may form at least a portion of an upper for the article of footwear 200. In these illustrated examples, the article of footwear 200 consists of (or consists essentially of) the sole structure 204 (e.g., midsole component 204M and outsole component 204O) and the bladder system 100 (optionally with a support layer 150). The first side chamber portion 120 and the second side chamber portion 130 may be structured and arranged to extend over an instep portion of a wearer's foot (e.g., in a midfoot and/or forefoot region of the article of footwear 200). These side chamber portions 120, 130, together with the foot support chamber portion 110, define a foot receiving chamber 108.

In use, when a wearer dons the article of footwear 200, downward force on the foot support chamber portion 110 from the wearer's foot will move fluid through the first side fluid passageway 112A and the second side fluid passageway 112B and into the first side chamber portion 120 and the second side chamber portion 130, respectively. The fluid moving into the first side chamber portion 120 and/or the second side chamber portion 130 may displace or expand the first side chamber portion 120 and/or the second side chamber portion 130 into contact with the wearer's foot (e.g., in the instep area). The movement of fluid may help maintain secure contact with the wearer's foot, provide a comfortable feel, and provide impact force attenuation.

When inflated with gas, the foot support chamber portion 110 may contain a first volume ($V_{110}$), the first side chamber portion 120 may contain a second volume ($V_{120}$), and the third side chamber portion 130 may contain a third volume ($V_{130}$). These chamber volumes may have any one or more and/or any combination of the following properties:

| | |
|---|---|
| $V_{110} = 0.75 \times V_{120}$ to $3 \times V_{120}$ | $V_{110} = 0.8 \times V_{120}$ to $2.5 \times V_{120}$ |
| $V_{110} = 0.85 \times V_{120}$ to $2.25 \times V_{120}$ | $V_{110} = 1 \times V_{120}$ to $2 \times V_{120}$ |
| $V_{110} = 0.75 \times V_{130}$ to $3 \times V_{130}$ | $V_{110} = 0.8 \times V_{130}$ to $2.5 \times V_{130}$ |
| $V_{110} = 0.85 \times V_{130}$ to $2.25 \times V_{130}$ | $V_{110} = 1 \times V_{130}$ to $2 \times V_{130}$ |
| $V_{110}$ = At least 50 $cm^3$ | $V_{110}$ = 50 $cm^3$ to 500 $cm^3$ |
| $V_{110}$ = 60 $cm^3$ to 400 $cm^3$ | $V_{110}$ = 80 $cm^3$ to 350 $cm^3$ |
| $V_{120}$ = At least 30 $cm^3$ | $V_{120}$ = 30 $cm^3$ to 400 $cm^3$ |
| $V_{120}$ = 40 $cm^3$ to 350 $cm^3$ | $V_{120}$ = 50 $cm^3$ to 300 $cm^3$ |
| $V_{130}$ = At least 30 $cm^3$ | $V_{130}$ = 30 $cm^3$ to 400 $cm^3$ |
| $V_{130}$ = 40 $cm^3$ to 350 $cm^3$ | $V_{130}$ = 50 $cm^3$ to 300 $cm^3$ |

Within the side chamber portion(s) 120, 130 and/or the footwear upper components or straps containing them, the overall strap/footwear upper component structure may include fluid over any desired proportion of the area of the side chamber portion(s) 120, 130 and/or strap/footwear upper component structure. For example, in the straps/footwear upper component formed to include one or both of the side chamber portions 120, 130, the "fluid containing area" of each individual strap/footwear upper component and/or each individual side chamber portion 120, 130 (e.g., the combined area within an individual strap/footwear upper component or individual side chamber portion 120, 130 covered by bottom base chamber portion 160B, top base chamber portion 160T, forward chamber portion 160F, rearward chamber portion 160R, and any intermediate chamber portion 160I1, 160I2, 160I3 and not counting the interior bond 104I area in the example of FIGS. 1-4) may comprise at least 25% of the overall strap/footwear upper component area and/or at least 25% of that overall side chamber portion 120, 130 area. In some examples, for either or both of the individual straps/footwear upper components and/or side chamber portions 120 and/or 130, the "fluid containing area" will comprise from 25% to 90%, from 30% to 80%, from 35% to 75%, or even from 40% to 70% of the overall strap/footwear upper component area and/or the overall side chamber portion 120, 130 area.

In the example of FIGS. 1A-4, the two side chamber portions 120, 130 are substantially the same size and have substantially similar (e.g., mirror image) structures and parts, including similarly sized and shaped bottom base chamber portions 160B, top base chamber portions 160T, forward chamber portions 160F, rearward chamber portions 160R, intermediate chamber portions 160I1, 160I2, 160I3, and internal bonds 104I. This is not a requirement. For example, the various chamber portions 160B, 160T, 160F, 160R, 160I1, 160I2, 160I3 and/or internal bonds 104I on one side chamber portion 120, 130 may differ in size, shape, location, area, volume, and/or orientation, etc. from any chamber portions (if any) provided on the other side chamber portion 130, 120. Additionally or alternatively, if desired, the securing strap and/or footwear upper component on one side may be longer and/or wider than the securing strap and/or footwear upper component on the other side. As yet another alternative, if desired, a bladder system 100 could be provided having just one fluid-containing side chamber portion 120 or 130 (i.e., having a fluid-filled bladder portion extending from only one side of the foot support bladder portion 110). In such structures, the other side of the article of footwear may include a strap without a fluid-containing bladder chamber portion and/or just a portion of a securing system for securing to the strap having the fluid-filled bladder chamber portion. A wide variety of modifications to the securing straps and their side chamber portions are possible within examples of this technology.

While the figures illustrate the first and second side bladder chamber portions 120 and 130 as securing straps for an article of footwear, as noted above, the side bladder chamber portion(s) 120 and/or 130 may comprise at least portions of one or more footwear upper components, e.g., footwear upper components that are not part of a releasable securing strap. Such bladder systems 100 and/or articles of footwear may include first and/or second side bladder chamber portions 120 and/or 130 that are permanently and fixedly engaged to one another and/or to other components in the footwear structure. Such first and/or second side bladder chamber portions 120 and/or 130 (when not present as part of a releasable securing strap) may form one or more of: (i) at least a portion of a footwear instep upper component (e.g., for supporting and/or protecting the instep region of a wearer's foot), (ii) at least a portion of a forefoot lateral side upper component (e.g., for supporting and/or protecting the forefoot lateral side of a wearer's foot), (iii) at least a portion of a forefoot medial side upper component (e.g., for supporting and/or protecting the forefoot medial side of a wearer's foot), (iv) at least a portion of a midfoot lateral side upper component (e.g., for supporting and/or protecting the midfoot lateral side of a wearer's foot), (v) at least a portion of a midfoot medial side upper component (e.g., for supporting and/or protecting the midfoot medial side of a wearer's foot, (vi) at least a portion of a heel lateral side upper component (e.g., for supporting and/or protecting the heel lateral side of a wearer's foot), and/or (vii) at least a portion of a heel medial side upper component (e.g., for supporting and/or protecting the heel medial side of a wearer's foot.

Additionally or alternatively, in at least some examples of this technology, the foot support chamber portion 110 may comprise at least a portion of a strobel component for an article of footwear in which the bladder system 100 is incorporated. For example, bottom edges of one or more footwear upper components may be engaged with the outer perimeter bond 104 and/or the support layer 150 such that the foot support chamber portion 110 (at least in part) closes off the bottom of the footwear upper. The foot support bladder chamber portion 110 and bladder system 100 may be engaged with a sole structure (e.g., a footwear midsole and/or outsole component), e.g., by one or more of adhesives, sewing, fusing techniques, mechanical connectors, etc. Also, while the illustrated examples show a sandal, slide, or flip-flop type article of footwear, aspects of this technology may be used in any desired type of footwear structure, including athletic footwear, casual footwear, etc.

While FIGS. 1A-5 illustrate various different bladder sizes, shapes, and specific configurations, many variations in bladder sizes, shapes, and/or configurations are possible without departing from this technology. The specifically illustrated bladders could be varied widely in size, shape, and/or configuration while still providing the desired functions and/or properties described above.

III. Conclusion

The present invention is disclosed above and in the accompanying drawings with reference to a variety of example structures. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims.

For the avoidance of doubt, the present application includes at least the subject matter described in the following numbered Clauses:

Clause 1. A bladder system for an article of footwear, comprising:

a first thermoplastic elastomer sheet; and a second thermoplastic elastomer sheet joined to the first thermoplastic elastomer sheet by an outer perimeter bond, wherein an interior chamber is defined between the first thermoplastic elastomer sheet and the second thermoplastic elastomer sheet and inside of the outer perimeter bond, and wherein the outer perimeter bond is shaped such that the interior chamber forms:

(i) a foot support chamber portion for supporting at least a portion of a plantar surface of a wearer's foot, (ii) a first side chamber portion forming at least part of a first securing strap or a first footwear upper component, wherein the first side chamber portion extends outward from a first side of the foot support chamber portion and is in fluid communication with the foot support chamber portion, and (iii) a second side chamber portion forming at least part of a second securing strap or a second footwear upper component, wherein the second side chamber portion extends outward from a second side of the foot support chamber portion and is in fluid communication with the foot support chamber portion, wherein the second side of the foot support chamber portion is opposite the first side of the foot support chamber portion.

Clause 2. The bladder system according to clause 1, wherein the foot support chamber portion extends to form a heel support portion, a midfoot support portion, and a forefoot support portion.

Clause 3. The bladder system according to clause 2, wherein each of the heel support portion, the midfoot support portion, and the forefoot support portion of the foot support chamber portion includes a plurality of interior bonds between interior surfaces of the first thermoplastic elastomer sheet and the second thermoplastic elastomer sheet.

Clause 4. The bladder system according to clause 1 or 2, wherein the foot support chamber portion includes a plurality of interior bonds between interior surfaces of the first thermoplastic elastomer sheet and the second thermoplastic elastomer sheet.

Clause 5. The bladder system according to any one of clauses 1 to 4, wherein a first side fluid passageway connects the foot support chamber portion with the first side chamber portion, and wherein a second side fluid passageway connects the foot support chamber portion with the second side chamber portion.

Clause 6. The bladder system according to clause 5, wherein the first side fluid passageway is located at a forefoot region or a midfoot region of the first side of the foot support chamber portion, and wherein the second side fluid passageway is located at a forefoot region or a midfoot region of the second side of the foot support chamber portion.

Clause 7. The bladder system according to any one of clauses 1 to 6, wherein the first side chamber portion includes a first plurality of elongated chamber segments in a staggered arrangement.

Clause 8. The bladder system according to clause 7, wherein the first plurality of elongated chamber segments have a longitudinal direction that extends in a front-to-back direction of the bladder system.

Clause 9. The bladder system according to clause 7 or clause 8, wherein the second side chamber portion includes a second plurality of elongated chamber segments in a staggered arrangement.

Clause 10. The bladder system according to clause 9, wherein the second plurality of elongated chamber segments have a longitudinal direction that extends in a front-to-back direction of the bladder system.

Clause 11. The bladder system according to any one of clauses 1 to 6, wherein the first side chamber portion includes: (i) a first bottom base chamber portion, (ii) a first top base chamber portion, (iii) a first forward chamber portion extending between the first bottom base chamber portion and the first top base chamber portion, and (iv) a first rearward chamber portion extending between the first bottom base chamber portion and the first top base chamber portion.

Clause 12. The bladder system according to clause 11, wherein the first side chamber portion further includes (i) a first elongated chamber portion extending from the first rearward chamber portion toward the first forward chamber portion and terminating before reaching the first forward chamber portion, and (ii) a second elongated chamber portion extending from the first forward chamber portion toward the first rearward chamber portion and terminating before reaching the first rearward chamber portion.

Clause 13. The bladder system according to clause 12, wherein the first side chamber portion further includes a third elongated chamber portion extending from the first rearward chamber portion toward the first forward chamber portion and terminating before reaching the first forward chamber portion.

Clause 14. The bladder system according to any one of clauses 11 to 13, wherein the second side chamber portion includes: (i) a second bottom base chamber portion, (ii) a second top base chamber portion, (iii) a second forward chamber portion extending between the second bottom base chamber portion and the second top base chamber portion, and (iv) a second rearward chamber portion extending between the second bottom base chamber portion and the second top base chamber portion.

Clause 15. The bladder system according to clause 14, wherein the second side chamber portion further includes (i) a fourth elongated chamber portion extending from the second rearward chamber portion toward the second forward chamber portion and terminating before reaching the second forward chamber portion, and (ii) a fifth elongated chamber portion extending from the second forward chamber portion toward the second rearward chamber portion and terminating before reaching the second rearward chamber portion.

Clause 16. The bladder system according to clause 15, wherein the second side chamber portion further includes a sixth elongated chamber portion extending from the second rearward chamber portion toward the second forward chamber portion and terminating before reaching the second forward chamber portion.

Clause 17. The bladder system according to any one of clauses 1 to 16, further comprising a support layer engaged with the first thermoplastic elastomer sheet.

Clause 18. The bladder system according to clause 17, wherein the first side chamber portion comprises said at least part of the first securing strap, wherein the second side chamber portion comprises said at least part of the second securing strap, and wherein the bladder system further comprises a securing system having at least a portion engaged with the support layer, the securing system releasably holding the first securing strap in place with respect to the second securing strap so as to form a foot receiving space between: (i) the foot support chamber portion and (ii) the first securing strap and the second securing strap.

Clause 19. The bladder system according to clause 17 or 18, wherein the support layer comprises a fabric layer that forms a surface configured to contact a wearer's foot.

Clause 20. The bladder system according to any one of clauses 1 to 17, further comprising a securing system for releasably holding the first side chamber portion in place with respect to the second side chamber portion so as to form a foot receiving space between: (i) the foot support chamber portion and (ii) the first side chamber portion and the second side chamber portion.

Clause 21. A sole structure for an article of footwear, comprising:

a sole component; and a bladder system according to any one of clauses 1 to 20 engaged with the sole component.

Clause 22. The sole structure according to clause 21, wherein the foot support chamber portion is engaged with the sole component.

Clause 23. The sole structure according to clause 21, wherein the foot support chamber portion is engaged with a plantar support surface of the sole component.

Clause 24. The sole structure according to clause 23, wherein the plantar support surface of the sole component defines a recess into which the bladder system is received.

Clause 25. The sole structure according to any one of clauses 21 to 24, wherein the sole component comprises a foam component.

Clause 26. The sole structure according to any one of clauses 21 to 25, wherein the sole component comprises an outsole component.

Clause 27. An article of footwear, comprising:

a sole component; and a bladder system according to any one of clauses 1 to 20 engaged with the sole component.

Clause 28. The article of footwear according to clause 27, wherein the foot support chamber portion is engaged with the sole component.

Clause 29. The article of footwear according to clause 27, wherein the foot support chamber portion is engaged with a plantar support surface of the sole component.

Clause 30. The article of footwear according to clause 29, wherein the plantar support surface of the sole component defines a recess into which at least a portion of the bladder system is received.

Clause 31. The article of footwear according to any one of clauses 27 to 30, wherein the sole component comprises a foam component.

Clause 32. The article of footwear according to any one of clauses 27 to 31, wherein the sole component includes an outsole as a ground-contacting surface.

Clause 33. The article of footwear according to any one of clauses 27 to 32, wherein the first side chamber portion and the second side chamber portion comprise at least portions of an upper for the article of footwear.

Clause 34. The article of footwear according to any one of clauses 27 to 32, wherein the first side chamber portion comprises said at least part of the first footwear upper component, and wherein the second side chamber portion comprises said at least part of the second footwear upper component.

Clause 35. An article of footwear, consisting essentially of:

a sole member including one or more of a midsole and an outsole; and a bladder system according to any one of clauses 1 to 20 engaged with the sole member.

Clause 36. The article of footwear according to clause 35, wherein the foot support chamber portion is engaged with the sole member.

Clause 37. The article of footwear according to clause 35, wherein the foot support chamber portion is engaged with a plantar support surface of the sole member.

Clause 38. The article of footwear according to clause 37, wherein the plantar support surface of the sole member defines a recess into which at least a portion of the bladder system is received.

Clause 39. The article of footwear according to any one of clauses 35 to 38, wherein the sole member includes the midsole, and wherein the midsole includes a foam component.

Clause 40. The article of footwear according to any one of clauses 35 to 39, wherein the sole member includes the outsole as a ground-contacting surface.

Clause 41. The article of footwear according to any one of clauses 35 to 40, wherein the first side chamber portion and the second side chamber portion constitute an upper for the article of footwear.

Clause 42. The article of footwear according to any one of clauses 27 to 41, wherein the article of footwear constitutes a sandal, slide, or flip-flop.

Clause 43. A bladder system for an article of footwear, comprising:

a first thermoplastic elastomer sheet; and a second thermoplastic elastomer sheet joined to the first thermoplastic elastomer sheet by an outer perimeter bond, wherein an interior chamber is defined between the first thermoplastic elastomer sheet and the second thermoplastic elastomer sheet and inside of the outer perimeter bond, and wherein the outer perimeter bond is shaped such that the interior chamber forms:

(i) a foot support chamber portion for supporting at least a portion of a plantar surface of a wearer's foot, and (ii) a first side chamber portion forming at least part of a first securing strap and/or at least part of a first footwear upper component, wherein the first side chamber portion extends outward from a first side of the foot support chamber portion and is in fluid communication with the foot support chamber portion.

Clause 44. The bladder system according to clause 43, wherein the foot support chamber portion extends to form a heel support portion, a midfoot support portion, and a forefoot support portion.

Clause 45. The bladder system according to clause 44, wherein each of the heel support portion, the midfoot support portion, and the forefoot support portion of the foot support chamber portion includes a plurality of interior bonds between interior surfaces of the first thermoplastic elastomer sheet and the second thermoplastic elastomer sheet.

Clause 46. The bladder system according to clause 43 or 44, wherein the foot support chamber portion includes a plurality of interior bonds between interior surfaces of the first thermoplastic elastomer sheet and the second thermoplastic elastomer sheet.

Clause 47. The bladder system according to any one of clauses 43 to 46, wherein a first side fluid passageway connects the foot support chamber portion with the first side chamber portion.

Clause 48. The bladder system according to clause 47, wherein the first side fluid passageway is located at a forefoot region or a midfoot region of the first side of the foot support chamber portion.

Clause 49. The bladder system according to any one of clauses 43 to 48, wherein the first side chamber portion includes a first plurality of elongated chamber segments in a staggered arrangement.

Clause 50. The bladder system according to clause 49, wherein the first plurality of elongated chamber segments have a longitudinal direction that extends in a front-to-back direction of the bladder system.

Clause 51. The bladder system according to any one of clauses 43 to 48, wherein the first side chamber portion includes: (i) a first bottom base chamber portion, (ii) a first top base chamber portion, (iii) a first forward chamber portion extending between the first bottom base chamber portion and the first top base chamber portion, and (iv) a first rearward chamber portion extending between the first bottom base chamber portion and the first top base chamber portion.

Clause 52. The bladder system according to clause 51, wherein the first side chamber portion further includes (i) a first elongated chamber portion extending from the first rearward chamber portion toward the first forward chamber portion and terminating before reaching the first forward chamber portion, and (ii) a second elongated chamber portion extending from the first forward chamber portion toward the first rearward chamber portion and terminating before reaching the first rearward chamber portion.

Clause 53. The bladder system according to clause 52, wherein the first side chamber portion further includes a third elongated chamber portion extending from the first rearward chamber portion toward the first forward chamber portion and terminating before reaching the first forward chamber portion.

Clause 54. The bladder system according to any one of clauses 43 to 53, further comprising a support layer engaged with the first thermoplastic elastomer sheet.

Clause 55. The bladder system according to clause 54, wherein the first side chamber portion comprises said at least part of the first securing strap, and wherein the bladder system further comprises a securing system having at least a portion engaged with the support layer, the securing system releasably holding the first securing strap in place with respect to a wearer's foot.

Clause 56. The bladder system according to clause 54 or 55, wherein the support layer comprises a fabric layer that forms a surface configured to contact a wearer's foot.

Clause 57. The bladder system according to any one of clauses 43 to 54, further comprising a securing system for releasably holding the first side chamber portion in place with respect to a wearer's foot.

Clause 58. The bladder system according to any one of clauses 43 to 57, wherein the first side chamber portion comprises at least part of the first securing strap.

Clause 59. The bladder system according to any one of clauses 43 to 54, 56, or 57, wherein the first side chamber portion comprises at least part of the first footwear upper component.

Clause 60. A sole structure for an article of footwear, comprising:

a sole component; and a bladder system according to any one of clauses 43 to 59 engaged with the sole component.

Clause 61. The sole structure according to clause 60, wherein the foot support chamber portion is engaged with the sole component.

Clause 62. The sole structure according to clause 61, wherein the foot support chamber portion is engaged with a plantar support surface of the sole component.

Clause 63. The sole structure according to clause 62, wherein the plantar support surface of the sole component defines a recess into which the bladder system is received.

Clause 64. The sole structure according to any one of clauses 60 to 63, wherein the sole component comprises a foam component.

Clause 65. The sole structure according to any one of clauses 60 to 64, wherein the sole component comprises an outsole component.

Clause 66. An article of footwear, comprising:

a sole component; and a bladder system according to any one of clauses 43 to 59 engaged with the sole component.

Clause 67. The article of footwear according to clause 66, wherein the foot support chamber portion is engaged with the sole component.

Clause 68. The article of footwear according to clause 66, wherein the foot support chamber portion is engaged with a plantar support surface of the sole component.

Clause 69. The article of footwear according to clause 68, wherein the plantar support surface of the sole component defines a recess into which at least a portion of the bladder system is received.

Clause 70. The article of footwear according to any one of clauses 66 to 69, wherein the sole component comprises a foam component.

Clause 71. The article of footwear according to any one of clauses 66 to 70, wherein the sole component includes an outsole as a ground-contacting surface.

Clause 72. The article of footwear according to any one of clauses 66 to 71, wherein the first side chamber portion comprises said at least part of the first footwear upper component and forms at least a portion of an upper for the article of footwear.

Clause 73. The article of footwear according to any one of clauses 66 to 71, wherein the first securing strap comprises at least a portion of an upper for the article of footwear.

Clause 74. An article of footwear, consisting essentially of:

a sole member including one or more of a midsole and an outsole; and a bladder system according to any one of clauses 43 to 59 engaged with the sole member.

Clause 75. The article of footwear according to clause 74, wherein the foot support chamber portion is engaged with the sole member.

Clause 76. The article of footwear according to clause 74, wherein the foot support chamber portion is engaged with a plantar support surface of the sole member.

Clause 77. The article of footwear according to clause 76, wherein the plantar support surface of the sole member defines a recess into which at least a portion of the bladder system is received.

Clause 78. The article of footwear according to any one of clauses 74 to 77, wherein the sole member includes the midsole, and wherein the midsole includes a foam component.

Clause 79. The article of footwear according to any one of clauses 74 to 78, wherein the sole member includes the outsole as a ground-contacting surface.

Clause 80. The article of footwear according to any one of clauses 74 to 79, wherein the first side chamber portion constitutes an upper for the article of footwear.

Clause 81. The article of footwear according to any one of clauses 66 to 80, wherein the article of footwear constitutes a sandal, slide, or flip-flop.

What is claimed is:

1. A bladder system for an article of footwear, comprising:

a first thermoplastic elastomer sheet; and a second thermoplastic elastomer sheet joined to the first thermoplastic elastomer sheet by an outer perimeter bond, wherein an interior chamber is defined between the first thermoplastic elastomer sheet and the second thermoplastic elastomer sheet and inside of the outer perimeter bond, and wherein the outer perimeter bond is shaped such that the interior chamber forms:

(i) a foot support chamber portion for supporting at least a portion of a plantar surface of a wearer's foot, (ii) a first side chamber portion forming at least part of a first securing strap or a first footwear upper component, wherein the first side chamber portion extends outward from a first side of the foot support chamber portion and is in fluid communication with the foot support chamber portion, and (iii) a second side chamber portion forming at least part of a second securing strap or a second footwear upper component, wherein the second side chamber portion extends outward from a second side of the foot support chamber portion and is in fluid communication with the foot support chamber portion, wherein the second side of the foot support chamber portion is opposite the first side of the foot support chamber portion wherein the first side chamber portion includes a first plurality of elongated chamber segments in a staggered arrangement;

wherein the first plurality of elongated chamber segments have a longitudinal direction that extends in a front-to-back direction of the bladder system;

wherein the second side chamber portion includes a second plurality of elongated chamber segments in a staggered arrangement; and wherein the second plurality of elongated chamber segments have a longitudinal direction that extends in a front-to-back direction of the bladder system.

2. The bladder system according to claim 1, wherein the foot support chamber portion includes a plurality of interior bonds between interior surfaces of the first thermoplastic elastomer sheet and the second thermoplastic elastomer sheet.

3. The bladder system according to claim 1, wherein the foot support chamber portion extends to form a heel support portion, a midfoot support portion, and a forefoot support portion.

4. The bladder system according to claim 3, wherein each of the heel support portion, the midfoot support portion, and the forefoot support portion of the foot support chamber portion includes a plurality of interior bonds between interior surfaces of the first thermoplastic elastomer sheet and the second thermoplastic elastomer sheet.

5. The bladder system according to claim 1, wherein a first side fluid passageway connects the foot support chamber portion with the first side chamber portion, and wherein a second side fluid passageway connects the foot support chamber portion with the second side chamber portion.

6. The bladder system according to claim 5, wherein the first side fluid passageway is located at a forefoot region or a midfoot region of the first side of the foot support chamber portion, and wherein the second side fluid passageway is located at a forefoot region or a midfoot region of the second side of the foot support chamber portion.

7. The bladder system according to claim 1, wherein the first side chamber portion includes: (i) a first bottom base chamber portion, (ii) a first top base chamber portion, (iii) a first forward chamber portion extending between the first bottom base chamber portion and the first top base chamber portion, and (iv) a first rearward chamber portion extending between the first bottom base chamber portion and the first top base chamber portion.

8. The bladder system according to claim 7, wherein the first side chamber portion further includes (i) a first elongated chamber portion extending from the first rearward chamber portion toward the first forward chamber portion and terminating before reaching the first forward chamber portion, and (ii) a second elongated chamber portion extending from the first forward chamber portion toward the first rearward chamber portion and terminating before reaching the first rearward chamber portion.

9. The bladder system according to claim 8, wherein the first side chamber portion further includes a third elongated chamber portion extending from the first rearward chamber portion toward the first forward chamber portion and terminating before reaching the first forward chamber portion.

10. The bladder system according to claim 1, further comprising a support layer engaged with the first thermoplastic elastomer sheet.

11. The bladder system according to claim 10, wherein the first side chamber portion comprises said at least part of the first securing strap, wherein the second side chamber portion comprises said at least part of the second securing strap, and wherein the bladder system further comprises a securing system having at least a portion engaged with the support layer, the securing system releasably holding the first securing strap in place with respect to the second securing strap so as to form a foot receiving space between: (i) the foot support chamber portion and (ii) the first securing strap and the second securing strap.

12. An article of footwear, comprising:

a sole component; and a bladder system comprising:

a first thermoplastic elastomer sheet; and a second thermoplastic elastomer sheet joined to the first thermoplastic elastomer sheet by an outer perimeter bond, wherein an interior chamber is defined between the first thermoplastic elastomer sheet and the second thermoplastic elastomer sheet and inside of the outer perimeter bond, and wherein the outer perimeter bond is shaped such that the interior chamber forms:

(i) a foot support chamber portion for supporting at least a portion of a plantar surface of a wearer's foot, (ii) a first side chamber portion forming at least part of a first securing strap or a first footwear upper component, wherein the first side chamber portion extends outward from a first side of the foot support chamber portion and is in fluid communication with the foot support chamber portion, and (iii) a second side chamber portion forming at least part of a second securing strap or a second footwear upper component, wherein the second side chamber portion extends outward from a second side of the foot support chamber portion and is in fluid communication with the foot support chamber portion, wherein the second side of the foot support chamber portion is opposite the first side of the foot support chamber portion;

wherein the first side chamber portion includes a first plurality of elongated chamber segments in a staggered arrangement;

wherein the first plurality of elongated chamber segments have a longitudinal direction that extends in a front-to-back direction of the bladder system;

wherein the second side chamber portion includes a second plurality of elongated chamber segments in a staggered arrangement; and wherein the second plurality of elongated chamber segments have a longitudinal direction that extends in a front-to-back direction of the bladder system.

13. The article of footwear according to claim 12, wherein the foot support chamber portion is engaged with a plantar support surface of the sole component.

14. The article of footwear according to claim 13, wherein the plantar support surface of the sole component defines a recess into which at least a portion of the bladder system is received.

15. A bladder system for an article of footwear, comprising:

a first thermoplastic elastomer sheet; and a second thermoplastic elastomer sheet joined to the first thermoplastic elastomer sheet by an outer perimeter bond, wherein an interior chamber is defined between the first thermoplastic elastomer sheet and the second thermoplastic elastomer sheet and inside of the outer perimeter bond, and wherein the outer perimeter bond is shaped such that the interior chamber forms:

(i) a foot support chamber portion for supporting at least a portion of a plantar surface of a wearer's foot, and (ii) a first side chamber portion forming at least part of a first securing strap and/or at least part of a first footwear upper component, wherein the first side chamber portion extends outward from a first side of the foot support chamber portion and is in fluid communication with the foot support chamber portion;

wherein the first side chamber portion includes a first plurality of elongated chamber segments in a staggered arrangement;

wherein the first plurality of elongated chamber segments have a longitudinal direction that extends in a front-to-back direction of the bladder system;

wherein the second side chamber portion includes a second plurality of elongated chamber segments in a staggered arrangement; and wherein the second plurality of elongated chamber segments have a longitudinal direction that extends in a front-to-back direction of the bladder system.

16. The bladder system according to claim 15, wherein the foot support chamber portion extends to form a heel support portion, a midfoot support portion, and a forefoot support portion.

17. The bladder system according to claim 16, wherein each of the heel support portion, the midfoot support portion, and the forefoot support portion of the foot support chamber portion includes a plurality of interior bonds between interior surfaces of the first thermoplastic elastomer sheet and the second thermoplastic elastomer sheet.

18. The bladder system according to claim 17, wherein a first side fluid passageway connects the foot support chamber portion with the first side chamber portion.

* * * * *